US009915118B2

(12) United States Patent
Moe

(10) Patent No.: US 9,915,118 B2
(45) Date of Patent: Mar. 13, 2018

(54) SUBSEA HORIZONTAL CHRISTMAS TREE

(75) Inventor: Sigurd Moe, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 1804 days.

(21) Appl. No.: 12/734,783

(22) PCT Filed: Nov. 24, 2008

(86) PCT No.: PCT/NO2008/000421

§ 371 (c)(1),
(2), (4) Date: Aug. 19, 2010

(87) PCT Pub. No.: WO2009/067026

PCT Pub. Date: May 28, 2009

(65) Prior Publication Data

US 2010/0307763 A1 Dec. 9, 2010

(30) Foreign Application Priority Data

Nov. 23, 2007 (NO) ..... 20076033

(51) Int. Cl.
*E21B 33/035* (2006.01)
*E21B 33/12* (2006.01)

(52) U.S. Cl.
CPC ..... *E21B 33/035* (2013.01)

(58) Field of Classification Search
CPC ..... E21B 33/035
USPC ..... 166/368, 65.1, 126, 192
See application file for complete search history.

(56) References Cited

U.S. PATENT DOCUMENTS

| | | | | |
|---|---|---|---|---|
| 3,946,805 | A | 3/1976 | Peterman | |
| 4,363,168 | A * | 12/1982 | Bryer et al. | 29/869 |
| 4,767,349 | A * | 8/1988 | Pottier et al. | 439/191 |
| 5,544,707 | A * | 8/1996 | Hopper et al. | 166/382 |
| 6,478,086 | B1 | 11/2002 | Hansen | |
| 7,654,329 | B2 * | 2/2010 | Lindland et al. | 166/368 |
| 2001/0011593 | A1 | 8/2001 | Wilkins | |
| 2005/0028980 | A1 | 2/2005 | Page et al. | |
| 2009/0173493 | A1 * | 7/2009 | Hutin et al. | 166/250.01 |

FOREIGN PATENT DOCUMENTS

| | | |
|---|---|---|
| GB | 2 320 513 A | 6/1998 |
| GB | 2 418 945 B | 5/2007 |
| WO | WO 99/63202 A1 | 12/1999 |

* cited by examiner

*Primary Examiner* — James G Sayre

(57) ABSTRACT

The present invention relates to a horizontal Christmas tree comprising a central bore (72) and a horizontal outlet (70) extending laterally from the central bore. A tubing hanger (74) is locked into the central bore and connected to a production tubing (76) extending into the well. The tubing hanger comprises a first passage (78) axially aligned with the production tubing and a second passage (80) extending laterally from the first passage and aligned with the outlet. The first passage comprises means for releasable fastening of at least one plugging device (1*a*, 1*b*) for plugging the first passage above the second passage.

3 Claims, 5 Drawing Sheets

Fig. 1: Prior Art: Horizontal Xmas tree

SUBSEA HORIZONTAL CHRISTMAS TREE

FIELD OF THE INVENTION

The present invention relates to a subsea horizontal Christmas tree comprising a plugging device comprising communication means for downhole communication.

BACKGROUND OF THE INVENTION

Oilfield production systems normally feature controls and monitoring devices in the well, at the Christmas tree and at the hydrocarbon receiving facility.

There is a need for communication between the downhole devices, such as sensors, actuators, etc, and the other parts of the oilfield production system. The communication between the downhole devices and access points outside the Christmas tree is today normally performed via cabling and piping in the annulus between the production tubing and the casing. At the Christmas tree, the production tubing is hung off and the tubing hanger contains electric, optical and hydraulic/chemical couplers between the tubing hanger and the Christmas tree. In the Christmas tree, communication is via cables, optical fibers and piping to new connectors at the access points external at the Christmas tree. From these access points in a subsea system, the communication to the overall control system typically to a Subsea Control Module (SCM) via traditional cables, optical fibers, hoses and piping. This downhole communication system is robust, does not interfere with the internal production bore and may contain many passages, but it may not be changed or repaired during the life of field without expensive and complex operations. These operations involve retrieval of the Christmas tree and/or the production tubing.

Plugging devices are used in oilfield production systems in the production tubing during the installation phase to provide temporary isolation and sealing, and during the production phase to provide more permanent isolation and sealing of the temporary well access.

Several plugging devices for oil- and gas wells are known. Such plugging devices are for example used in a horizontal Christmas tree, as illustrated in FIG. 1. One such plugging device is known from Norwegian patent 322829.

WO9963202 describes a method and arrangement for monitoring reservoir parameters in subsea wells.

U.S. Pat. No. 6,478,086 describes a method for plugging wells, where communication is provided between a sensor provided under a seal down in the well and a connection part. Over the seal the well is filled with a temperable, liquid sealant.

The object of the invention is to provide a subsea horizontal Christmas tree comprising a plugging device comprising communication means for downhole communication, which provides possibilities for permanent well access for monitoring and control in horizontal trees. Moreover, the invention provides the possibility for easy retrofit of new downhole sensors, actuators and tools.

SUMMARY OF THE INVENTION

The present invention relates to a subsea horizontal Christmas tree, where the Christmas tree comprises a central bore and a horizontal outlet extending laterally from the central bore, and a tubing hanger locked into the central bore and connected to a production tubing extending into the well, the tubing hanger comprising a first passage axially aligned with the production tubing and a second passage extending laterally from the first passage and aligned with the outlet, where the first passage comprises means for releasable fastening of at least one plugging device for plugging the first passage above the second passage, characterized in that the plugging device comprises communication means for providing communication through the plug, where the communication means is connected to communication interfaces provided on the upper side and lower side of the plugging device respectively.

In an aspect of the invention, the communication means comprises an electrical communication wire for transferring electrical energy or electrical signals through the device.

In an aspect of the invention, the communication means comprises an optical fiber for transferring optical signals through the device.

In an aspect of the invention, the communication means comprises communication means for transferring infrared communication signals, electromagnetic communication signals, infrared communication signals, piezo-electric communication signals or other types or communication signals.

In an aspect of the invention, the communication means in provided through the plugging device by means of a communication feed-through comprising a pressure- and/temperature resisting material for protection of the communication means.

In an aspect of the invention, the pressure- and/temperature resisting material comprises glass, ceramics etc.

In an aspect of the invention, the device comprises communication connectors in the respective ends of the communication feed-through for connection to other communication equipment.

In an aspect of the invention, the communication connectors comprise a wet mate electrical connection.

In an aspect of the invention, it comprises a power supply unit.

In an aspect of the invention, it comprises a signal amplifying unit.

BRIEF DESCRIPTION OF THE DRAWINGS

In the following, an embodiment of the present invention will be described with reference to the enclosed drawings, where.

DETAILED DESCRIPTION OF THE INVENTION

Figure 1:
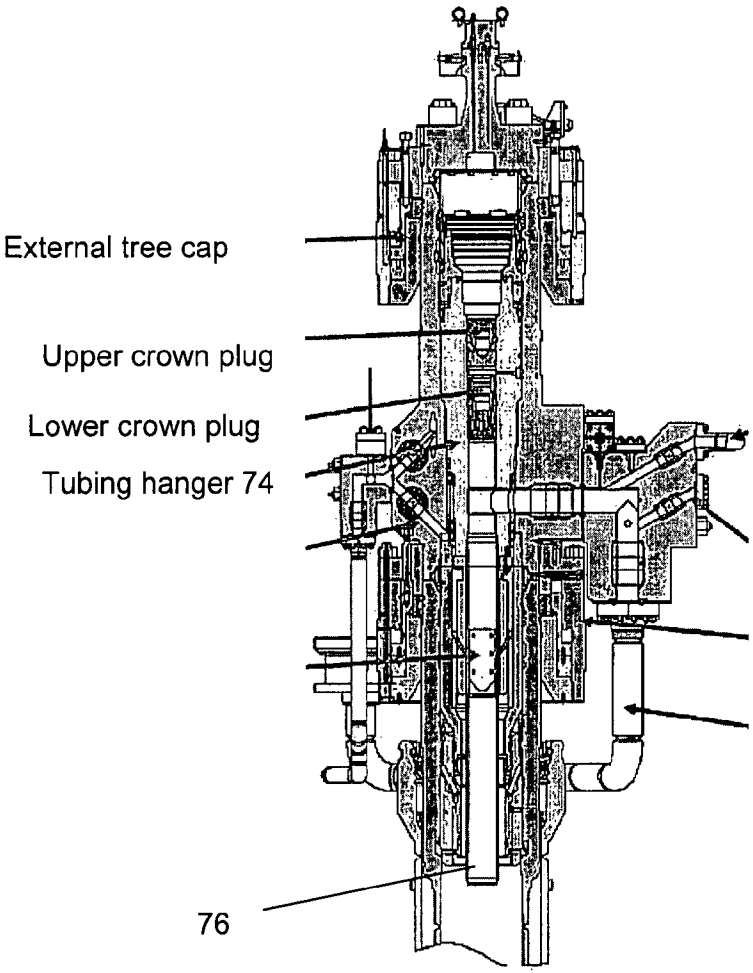
FIG. 1 illustrates a prior art Christmas tree with a plugging device in a horizontal Christmas tree.
Figure 2:
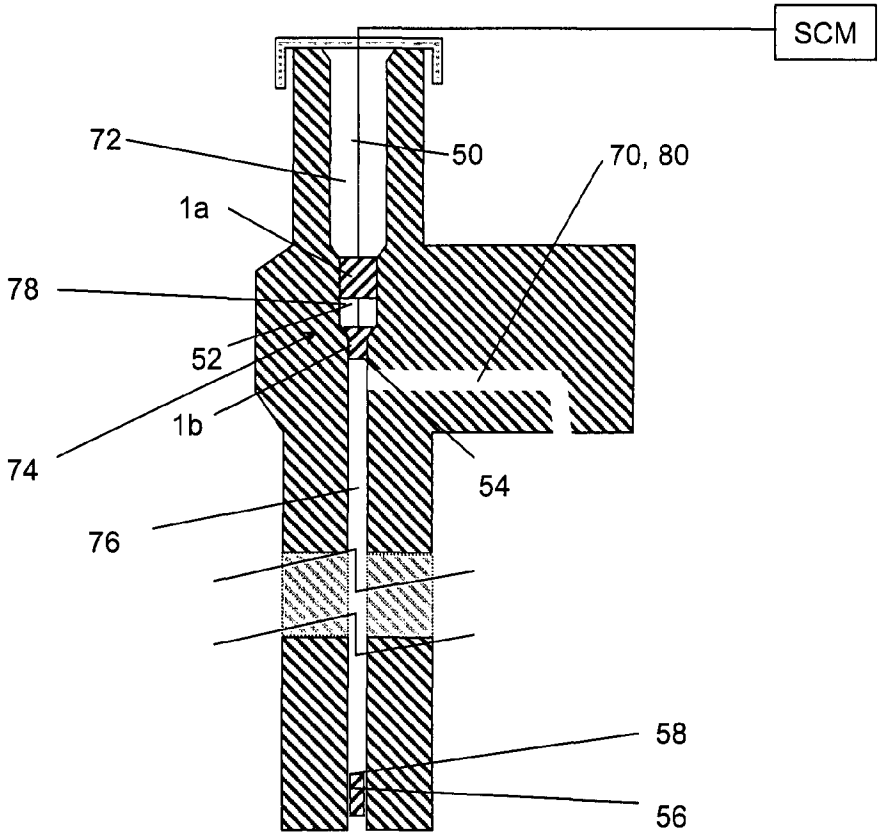
FIG. 2 illustrates an embodiment of the system according to the invention in a Christmas three as shown in FIG. 1.

It is now referred to FIG. 2, where an embodiment of invention is illustrated. FIG. 2 illustrates a horizontal Christmas tree of the same type as the prior art Christmas three shown in FIG. 1.

A first, upper device 1*a* and a second, lower device 1*b* are forming a double safety barrier in the horizontal Christmas tree.

As illustrated in FIG. 2, a subsea control module (SCM) is connected to the upper end of the first device 1*a* by means of a first connector 50. The first connector 50 is guided through a feedthrough of a debris cap on the top of the Christmas tree. The subsea control module SCM can be connected to a remote control station, for example a floating vessel, by means of umbilicals. In systems without SCMs (e.g. Direct Hydraulic systems), the communication may be directly to the vessel. The communication may also go via other communication hubs subsea, e.g. a Subsea Router Module.

The horizontal Christmas tree comprises a central bore 72 and a horizontal outlet 70 extending laterally from the central bore. A tubing hanger 74 is locked into the central bore 72 and connected to a production tubing 76 extending into the well. The tubing hanger 74 comprises a first passage 78 axially aligned with the production tubing 76 and a second passage 80 extending laterally from the first passage and aligned with the outlet 70. The first passage 78 comprises means for releasable fastening of at least one plugging device 1*a*, 1*b* for plugging the first passage above the second passage 80.

The plugging device comprises communication means for providing communication through the plug, where the communication means is connected to communication interfaces provided on the upper side and lower side of the plugging device respectively.

The first and second plugging devices 1*a*, 1*b* each have a communication feed-through comprising communication means, which will be explained in detail further below, for providing communication between their respective upper ends and lower ends. Hence, the communication means is provided through the plugging device by means of the communication feed-through.

Moreover, the lower end of the first device 1*a* is connected to the upper end of the second device 1*b* by means of a second connector 52. In the lower end of the second device 1*b*, a first wireless communication device 54 is provided.

Far down in the well it is provided a downhole device 56, for example a sensor or tool, comprising a second wireless communication device 58. The second wireless communication device 58 is provided for wireless communication with the first wireless communication device 54.

First Device 1*a*

Figure 3:
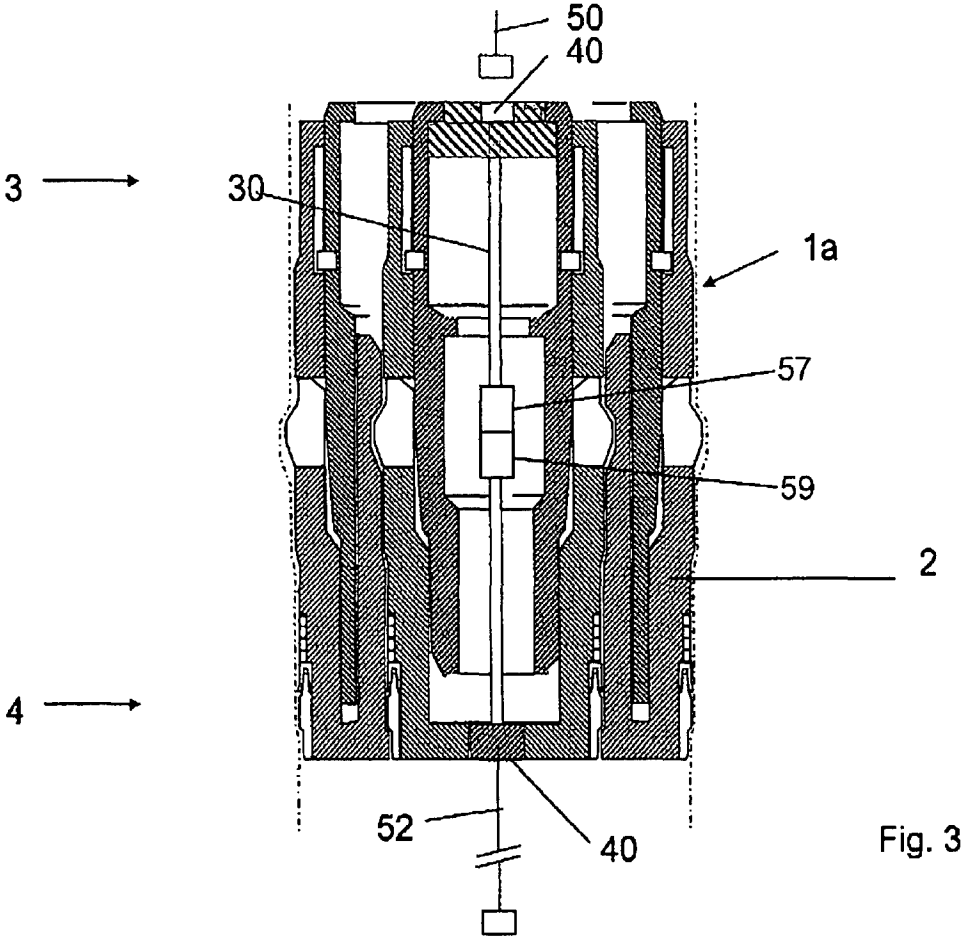
FIG. 3 illustrates an embodiment of the first or upper plugging device according to the invention of FIG. 2.

The first device 1*a* will now be described in detail with reference to FIG. 3. The device 1*a* comprises a plugging device or plug 2 for plugging of a well, as for example known from Norwegian patent No. 322829 and its corresponding U.S. Pat. No. 7,654,329, which are hereby incorporated by reference. The elements of the plugging device 2 will consequently not be described in detail here. It should be noted that the present invention is not limited to the above type of plugging device 2, and that several other types of plugging devices can be adapted for use with the present invention.

The first device 1*a* further comprises a communication feed-through 30 comprising communication means through the plugging device 2, for providing communication from a first, upper end 3 of the plugging device 2 to a second, lower end 4 of the plugging device 2.

The first device 1*a* further comprises communication connectors 40 in the respective ends of the communication feed-through 30. The communication connectors 40 comprise means for connecting the communication means of the communication feed-through 30 to other types of communication equipment. The communication connector 40 of the upper end 3 of the first device 1*a* is a connector adapted for connection to the end of the first connector 50.

The communication connector 40 of the lower end 4 of the first device 1*a* is a connector adapted for connection to the upper end of the second connector 52. Since the second device 1*b* will be inserted into the Christmas tree before the first device 1*a*, the second connector 52 could be a rigid element protruding downwardly from the lower end 4 of the first device 1*a*.

Second Device 1*b*

Figure 4:
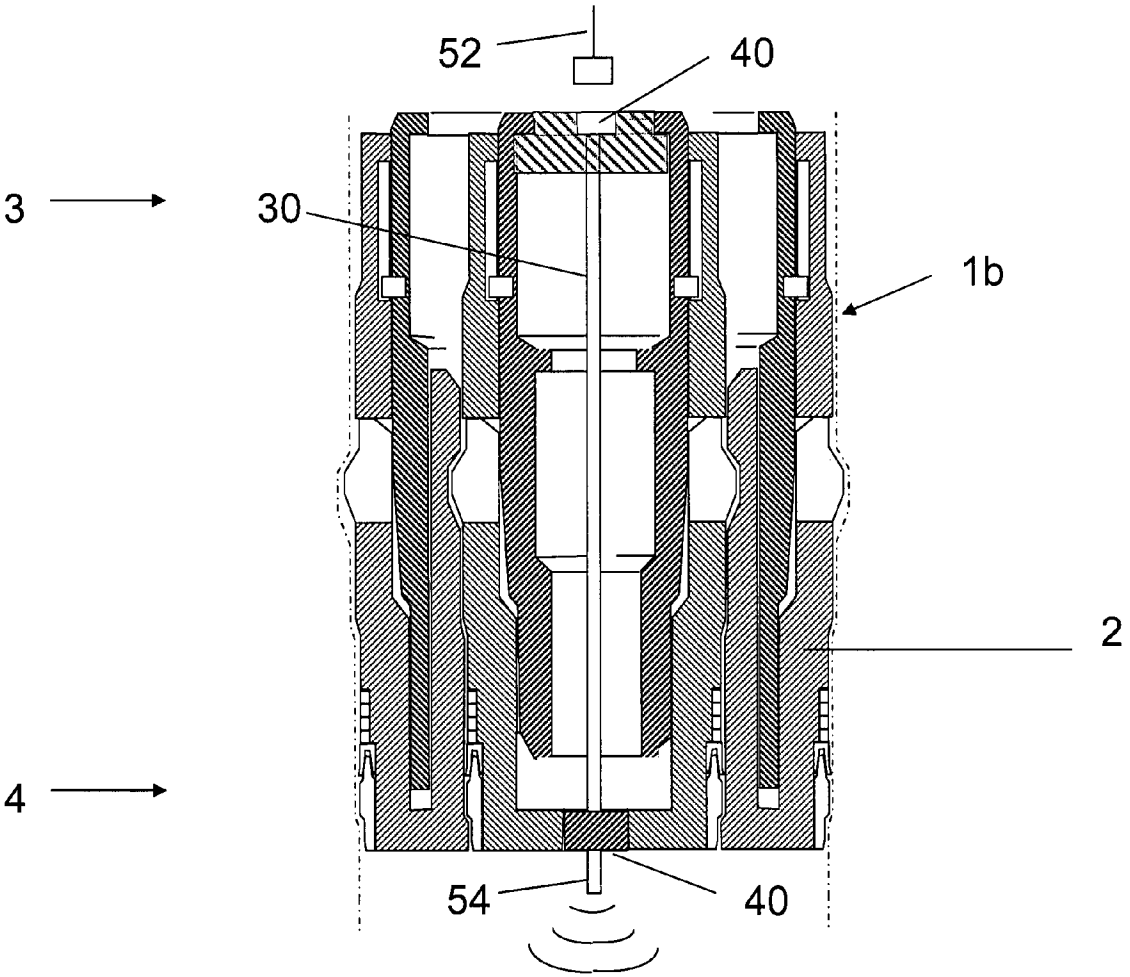
FIG. 4 illustrates an embodiment of the second or lower plugging device according to the invention of FIG. 2.
Figure 5:
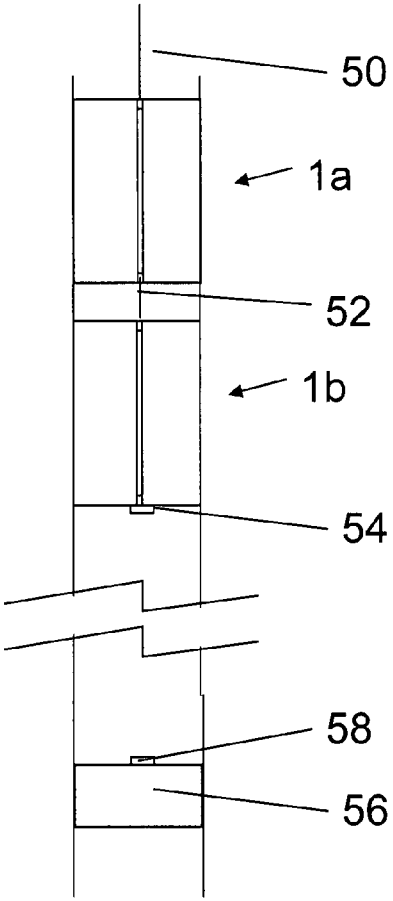
FIG. 5 is a simplified illustration of FIG. 2.

The second device 1*b* will now be described in detail with reference to FIG. 4. Like the first device 1*b* described above, the second device 1*b* comprises a plugging device or plug 2 for plugging of a well.

Also the second device 1*b* comprises a communication feed-through 30 comprising communication means through the plugging device 2, for providing communication from a first, upper end 3 of the plugging device 2 to a second, lower end 4 of the plugging device 2.

Moreover, the second device 1*b* further comprises communication connectors 40 in the respective ends of the communication means of the communication feed-through 30. The communication connectors 40 comprise means for connecting the communication means of the communication feed-through 30 to other types of communication equipment.

The communication connector 40 of the upper end 3 of the second device 1*b* is a connector adapted for connection to the end of the second connector 52. The connection between this communication connector 40 and the second connector 52 could for example be a type of prior art wet mate connector.

The communication connector 40 of the lower end 4 of the second device 1*b* is a connector adapted for connection to the wireless communication device 54.

In the description above, each of the first and second devices 1*a* and 1*b* have communication connectors 40 in both their respective ends. In this way, the devices 1*a*, 1*b* can be made in a batch production, and the needed communication connectors and other equipment can be connected to them according to the requirements for the different applications. Alternatively, the first device 1*a* is made with the second connector 52 being fixed to its lower end 4, and the second device 1*b* is made with the first wireless device 54 being fixed to its lower end 4.

In the description above, the communication means of the communication feed-through 30 comprises one or several electrical wires, for example enveloped in a temperature- and pressure resisting material. The electric wires comprise for example power cables for transferring electric energy (AC current or DC current) from the SCM through the first and second devices 1*a*, 1*b* to the first wireless communication device 54 and signal cables for transferring electric communication signals to and from the SCM through the first and second devices 1*a*, 1*b* to the first wireless communication device 54. Consequently, signals could be transferred between the SCM and the downhole device 56 via wireless connection and the communication feedthrough of the first and second devices 1*a* and 1*b*.

The temperature- and pressure resisting material can for example comprise glass, ceramics or other types of materials to protect the electric wires from the high temperatures or pressures that may occur in downhole wells. The devices 1*a*, 1*b* should function as a pressure barrier in the way usual plugging devices 2 does.

Alternatively, the communication means of the communication feed-through 30 comprises optic fibres for transferring optical communication signals. As shown in FIG. 3, it would also be possible to provide the first and second devices 1*a*, 1*b* with a power supply unit 57, for supplying power to the wireless communication device, for signal amplifiers 59, etc.

In yet another embodiment, the second connector 52 can be omitted. Here, the communication connector 40 of the lower end of the first device 1*a* and the communication connector of the upper end of the second device 1*b* can comprise a lens device for transferring an optical communication signal as light signals between the first and second devices 1*a* and 1*b*.

There are several other alternative embodiments of the present invention. For example, it would be possible to use communication methods based on inductive fields, electromagnetic pulse/vibration, piezo-electric pulse/vibration, infrared light etc.

It should be noted that the present invention is not limited to the type of plugging device described and shown in the drawings, it would be possible to use the present invention with several other types of plugs.

In the example above, in the lower end of the second device 1*b* a first wireless communication device 54 is provided. However, several types of equipment can be provided here, for example an instrument for monitoring pressure, temperature, erosion, or other type of parameters that are considered relevant for the subsea production process.

Moreover, the communication means of the communication feed-through can comprise an electrical communication wire for transferring electrical energy only. In this case, the lower end of the second device 1*b* can be connected to equipment that needs electrical power supply, such as power pumps or other power consumers located in the well.

In an alternative embodiment, the communication feed-through comprises communication means for transferring chemical or hydraulic fluid through the device 1*a*, 1*b*.

Moreover, the invention could comprise signal amplifiers, power supplying units in the form of batteries etc.

The invention claimed is:

1. In combination with a subsea horizontal Christmas tree which comprises a central bore and a horizontal outlet extending laterally from the central bore, a tubing hanger which is locked into the central bore and is connected to a production tubing extending into a well, the tubing hanger comprising a first passage which is axially aligned with the production tubing and a second passage which extends laterally from the first passage and is aligned with the outlet, the improvement comprising at least one plugging device which is releasably fastened in the first passage above the second passage, the plugging device comprising: a plug; and communication means for providing at least one of electrical or optical communication through the plug; wherein the communication means is connected to upper and lower communication interfaces provided on upper and lower sides of the plugging device, respectively, wherein the at least one plugging device comprises a first plugging device and the combination further comprises: a second plugging device which is releasably fastened in the first passage below the first plugging device and above the second passage; the second plugging device comprising a plug and communication means for providing at least one of electrical or optical communication through the plug; the communication means being connected to upper and lower communication interfaces provided on upper and lower sides of the second plugging device.

2. The combination of claim 1, further comprising a connector which is connected between the lower communication interface of the first plugging device and the upper communication interface of the second plugging device.

3. The combination of claim 2, wherein the connector comprises a rigid element that protrudes downwardly from the lower side of the first plugging device.

* * * * *